United States Patent [19]

Teranishi

[11] 3,973,381

[45] Aug. 10, 1976

[54] COVER FOR YARN TWISTING MACHINE

[75] Inventor: Junichi Teranishi, Joyoshi, Japan

[73] Assignee: Murata Kikai Kabushiki Kaisha, Kyoto, Japan

[22] Filed: Aug. 8, 1974

[21] Appl. No.: 495,660

[52] U.S. Cl. ..... 57/58.83; 57/56; 57/108

[51] Int. Cl.[2] ..... D01H 11/00; D01H 13/12; D01H 1/10

[58] Field of Search ..... 57/58.49, 58.7, 58.83, 57/58.86, 106, 107, 108, 1 R, 34 R, 56

[56] References Cited

UNITED STATES PATENTS 3,857,228 12/1974 Nakahara et al. ..... 57/56

*Primary Examiner*—John Petrakes

*Attorney, Agent, or Firm*—Whittemore, Hulbert & Belknap

[57] ABSTRACT

The present invention relates to a cover for enclosing an overall multiple-twisting machine. The cover comprises a balloon cover and a cover lid which is capable of opening or closing. The balloon cover includes a cylindrical tapered inner surface diverging upwardly and has an air exhaust port therewith.

1 Claim, 4 Drawing Figures

COVER FOR YARN TWISTING MACHINE

BACKGROUND OF THE INVENTION

The present invention relates to a cover for use in yarn twisting machine.

When operating multiple twisting machines such as a double twisting machine or a quadruple twisting machine, a principal problem has been deterioration of working environments on account of fly waste scattering from a yarn balloon or noises caused by rotation of the yarn twisting machine which is noticeably inferior in these regards in comparison with other types of machines used in the art of fibers.

To overcome the abovementioned problems, a method has been proposed and employed in recent years wherein a yarn twisting machine is enclosed as a whole by a cover. This method has solved the problem of noises sufficiently, but it has not been an adequate solution to the problem of exhaust of the fly waste. In this method, exhaust of fly waste is effected by means of an uprising spiral air stream caused by rotation of a rotary disk inside a yarn twisting space sealed by said cover from an air exhaust. More often than not, however, the air stream caused by the rotation of the rotary disk is not adequate enough to turn into a strong uprising air stream to arrive at the air exhaust. When the air stream is not exhausted in this manner, the fly waste is likewise not exhausted with the result that it often accumulates on a feed yarn or entangles with a balloon yarn. This, in turn, causes the balloon yarn to agitate the sealed air inside the cover and elevates the temperature inside the cover to lead further to change of moisture and deterioration of the yarn properties as the eventual consequence.

SUMMARY OF THE INVENTION

It is therefore the first object of the present invention to provide a cover for use in a yarn twisting machine which eliminates the abovementioned defects of prior covers by generating a smoothly rising air stream inside the cover.

When a yarn twisting machine is enclosed entirely by the cover, however, procedures of changing the feed yarn or of threading the yarn into spindles become difficult.

It is therefore the second object of this invention to provide a cover which facilitates the above-mentioned procedures during the operation.

Yarn balloons generated in a multiple twisting machine exert substantial influences over the yarn properties after the twisting. If the tensile strength of the yarn balloon is too strong, for example, the yarn causes fluffs because of friction at the time of passing through the yarn guides, and if it is too weak, the yarn likewise causes fluffs because of friction as the yarn entangles with the outer periphery of a yarn feed pot. In the worst case, it causes breaking of the yarn.

It is therefore important to always set the ballooning of the yarn at a most optimum value in accordance with the conditions of yarn twisting. The tensile strength of the yarn balloon varies in accordance with rotational speed of the spindle, count number of the yarn to be twisted or changes of other twisting conditions.

It is therefore the third object of this invention to provide a cover including structure for readily adjusting the tensile strength of the yarn balloon.

DETAILED DESCRIPTION OF THE INVENTION

The present invention will now be explained in further detail with respect to a double twisting machine as a typical embodiment by referring to the accompanying drawings.

Figure 1:
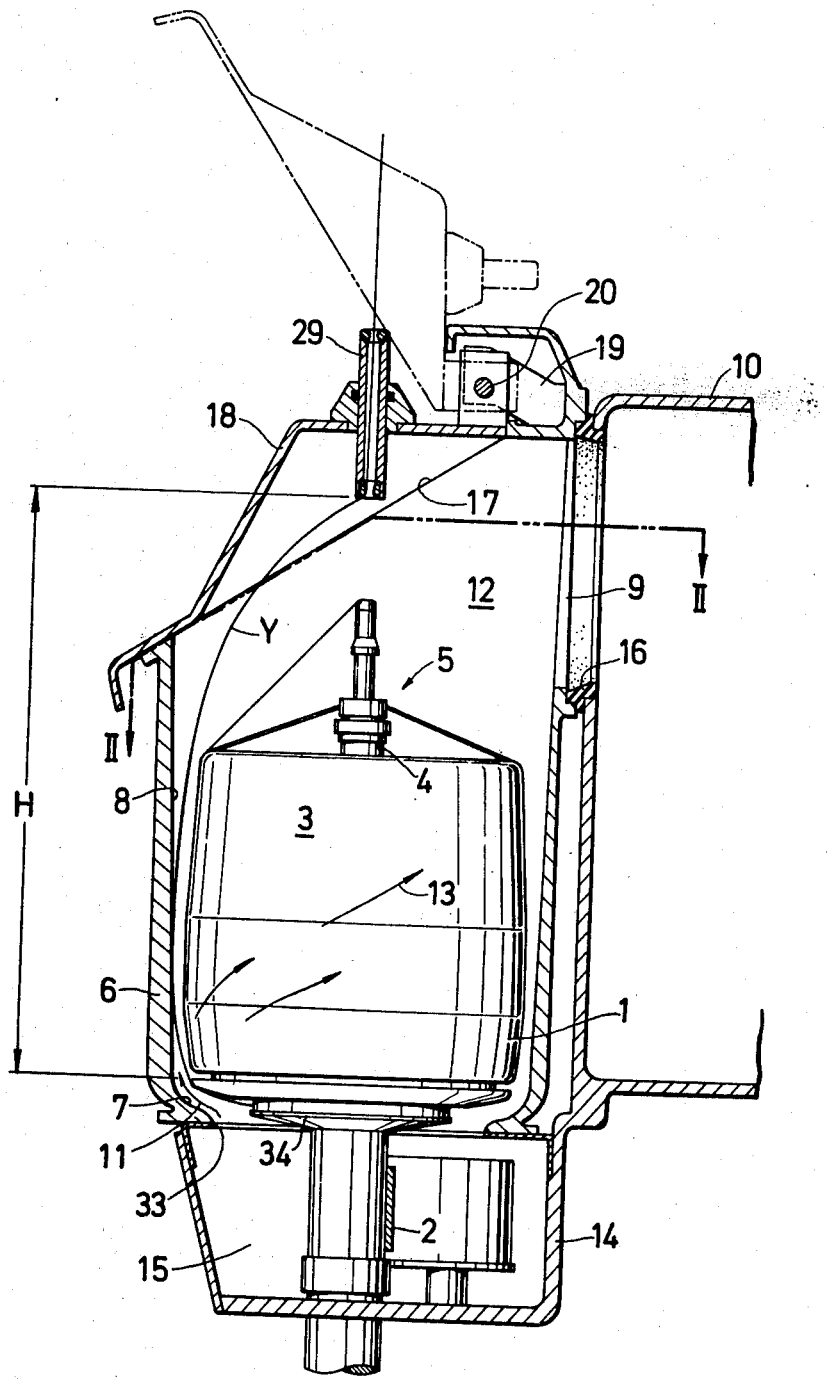
FIG. 1 is a longitudinal section view of the cover of the present invention and a twisting machine therein.
Figure 2:
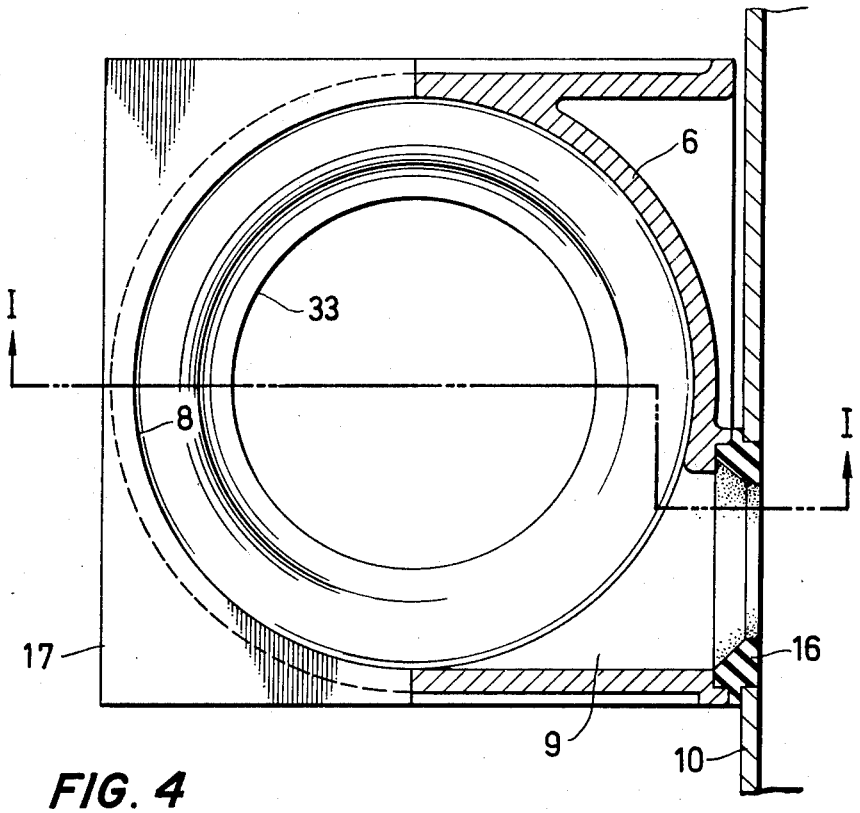
FIG. 2 is an enlarged section view of the cover taken substantially along the lines II—II of FIG. 1.
Figure 4:
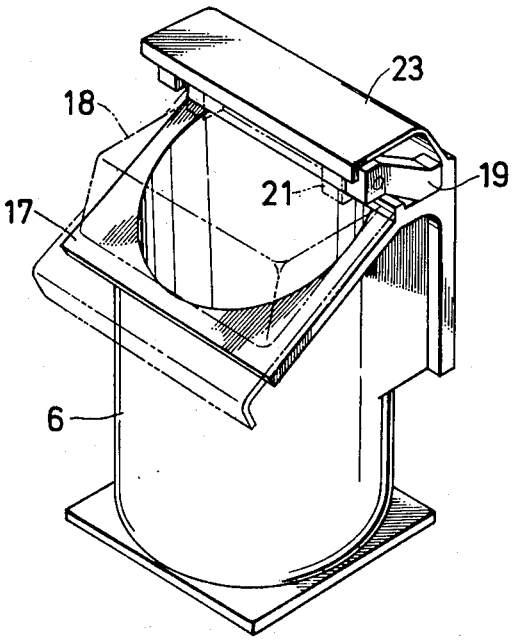
FIG. 4 is a reduced perspective view of the cover of the present invention.

In FIG. 1, the numeral 1 is a rotary disc which is rotated by means of a belt 2. The numeral 3 is a yarn feed pot, and a tension device is expressed by the numeral 4. All these components together make up a yarn twisting machine 5.

The numeral 6 denotes a cover to enclose the overall twisting machine composed of a balloon cover whose internal lower surface section is shaped so as to define a curved surface 7. The curved surface becomes narrower extending downwards and is connected to an upwardly diverging surface forming a taper 8 which is concentric with the rotary disc 1 and functions as a balloon limiting device. It is advisable to shape the transverse cross-section of the curved surface 7 to be annular and to merge with the taper 8 so as to generate a uniform uprising air stream. At a position above the upper section of the cover 6 where the balloon yarn does not get in touch with it, there is provided an air exhaust port 9 which is connected to a main duct 10 extending the entire longitudinal length of a machine support.

A centrifugal air stream generated by rotation of the rotary disc 1 strikes against the downwardly truncated curved surface 7 and is thereby converted into an uprising air stream 11. In order to ensure the generation of a smooth uprising air stream by means of the curved surface 7, it is desirable to locate the lower edge 33 of the curved surface 7 at a position lower than the lower edge section 34 of the rotary disc 1.

The uprising air stream 11 turns into an uprising swirling air stream 13 which is lead out from the air exhaust port 9 into the main duct 10 together with fly waste generated inside the yarn twisting space 12. The other end of the main duct 10 is connected to a suction device (not shown). The fly waste is collected and piled up at a predetermined location by means of suction of the suction device. The lower section of the main duct 10 is formed to include an L-shaped belt cover 14 which covers up a belt-running chamber 15 to muffle noises. The numeral 16 is a packing which interlockes the air exhaust port 9 and the main duct 10.

The upper section of the balloon cover is cut off to define a slant truncated open surface 17 which is covered by a cover lid 18 to render the twisting yarn space airtight. The open surface 17 is shaped as a slant surface such that the front section thereof is lower than the rear section, and the open area thereof is larger than the cross-sectional area of the tapered surface. The arrangement in this fashion ensures easier feed yarn change, threading of the yarn and so forth.

The cover lid 18 is pivotally connected to lugs 19 disposed protrudingly at both sides of the upper section of the balloon cover 6 by a pin 20. Thus, the cover lid 18 can be opened upwardly as shown in phantom in FIG. 1 at the time of changing the feed yarn, threading the yarn and the like.

Figure 3:
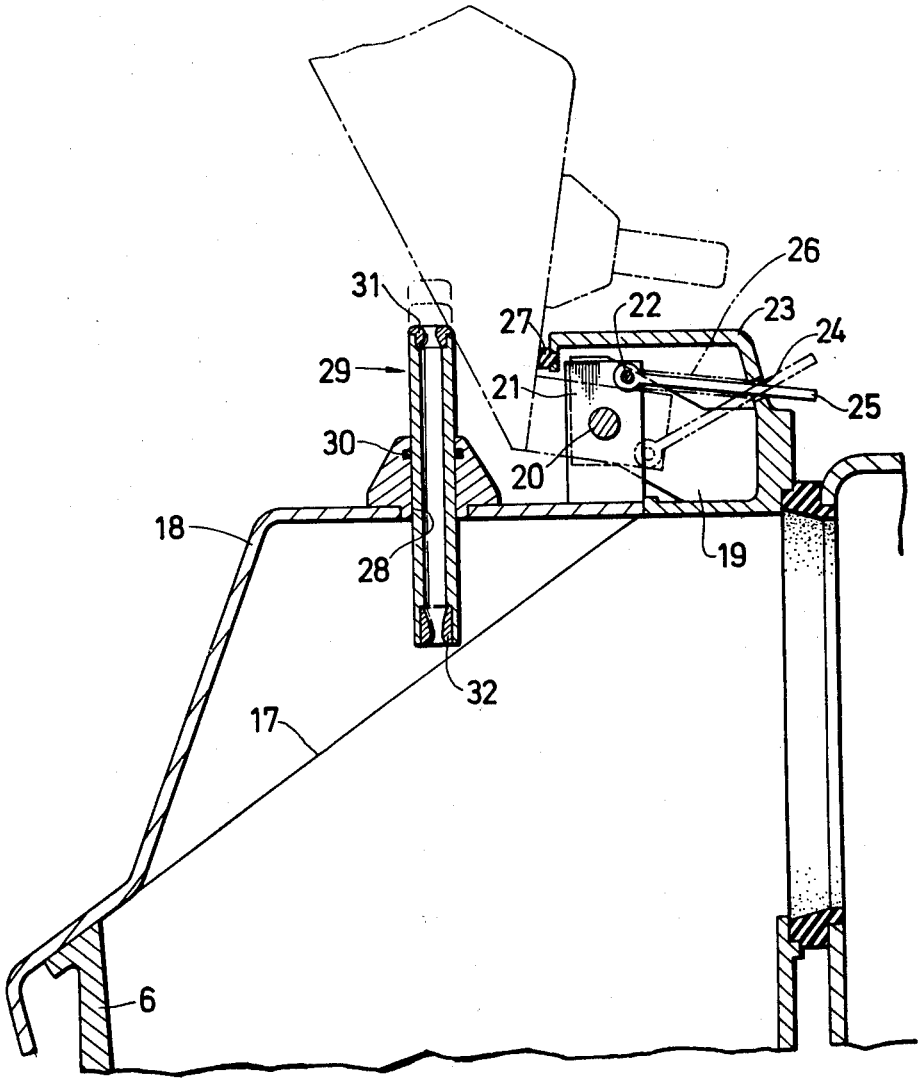
FIG. 3 is an enlarged partial section view of the upper portion of the cover similar to the view shown in FIG. 1.

As shown in FIG. 3 in further detail, there is provided a pin 22 protruding from a support section 21 of the cover lid 18 which supports a rod 25 past through a hole 24 bored on a covering plate 23 at the upper section of the balloon cover 6. Between the bearing section of the rod 25 and the covering plate 23, there is inserted a compression spring 26. When the cover lid 18 is closed as shown by full lines in FIGS. 1 and 3, this spring 26 urges the cover lid 18 around the pin 20 in a counter-clockwise direction whereby the cover lid 18 is pressed firmly to the slant open surface 17. When the cover lid 18 is opened as shown by dotted lines in FIGS. 1 and 3, the spring 26 urges the cover lid 18 in a clockwise direction around the pin 20 whereby the cover lid 18 is hit and retained by a stopper 27 disposed on the covering plate 23.

The cover lid 18 further has a hole 28 bored at its center into which a cylinder 29 is fitted slidably so as to guide the yarn. Positioning of the cylinder is readily adjustable in the hole 28 by means of an O-ring 30 fitted therein. In this manner, the position of the cylinder 29 with respect to the cover lid 18 can be regulated readily when twisting conditions are somehow changed so as to thereby change the height (H) of the balloon as indicated by dotted lines in FIG. 3 and set the tensile strength of the yarn balloon to an optimum value. The numerals 31, 32 stand for yarn guide members disposed respectively at the upper and lower edges of the cylinder 29. Provision of a scale on the outer surface of the cylinder makes it easy to determine the tensile strength of the yarn balloon.

What is claimed is:

1. A cover enclosing an overall multiple twisting machine including at least one rotary disc, said cover comprising a balloon cover having an upper section and a cover lid covering the upper section thereof, said balloon cover including an internal curved surface, the lower edge section of which curved surface is positioned lower than the lower edge section of the rotary disc of the multiple twisting machine, a cylindrical surface having a cross section which is concentric with the one rotary disc of the multiple twisting machine and which merges into the curved surface and diverges upwardly, an air exhaust port in the upper section of the balloon cover, said upper section of the balloon cover including a slanted truncated open surface lower at the front than at the rear of the balloon cover, said slanted truncated open surface being covered by said cover lid, hinge means securing the cover lid to the balloon cover at the rear of the slanted truncated open surface including a pair of lugs secured to the upper portion of the balloon cover at the opposite sides thereof and a covering plate secured to the upper portion of the balloon cover at the top thereof between the lugs including a portion in spaced relation to the uppermost portion of the cover lid in a closed position, support sections at each side of the cover lid secured to the uppermost portion of the cover lid at the rear thereof in the closed position of the cover lid whereby a portion of the support sections is adjacent the lugs on the balloon cover, pin means extending between the lugs and support sections for pivotally securing the lugs and support sections together, stopper means secured to the covering plate for limiting opening pivotal movement of the cover lid, an opening in the covering plate at the rear of the balloon cover, a rod, means pivotally securing the rod to the upper portion of one of the support sections, the other end of which rod extends through the opening in the covering plate, and a compression spring sleeved over the rod between the support section and covering plate whereby the compression spring urges the cover lid in a closed position when the cover lid is closed and urges the cover lid in an open position when the cover lid is open, and a yarn guide cylinder carried by the cover lid which is adjustable axially with respect to the cover lid.

* * * * *